US011402152B2

(12) United States Patent
Christensen et al.

(10) Patent No.: US 11,402,152 B2
(45) Date of Patent: Aug. 2, 2022

(54) LARGE SCALE COASTAL LIQUEFACTION

(71) Applicants: GREEN LNG SERVICES AS, Oslo (NO); Tor Christensen, Sandefjord (NO); Pål Leo Eckbo, Hanover, NH (US)

(72) Inventors: Tor Christensen, Sandefjord (NO); Pål Leo Eckbo, Hanover, NH (US)

(73) Assignees: Tor Christensen, Sandefjord (NO); Pål Leo Eckbo, Hanover, NH (US); GREEN LNG SERVICES AS, Oslo (NO)

( * ) Notice: Subject to any disclaimer, the term of this patent is extended or adjusted under 35 U.S.C. 154(b) by 277 days.

(21) Appl. No.: 16/627,902

(22) PCT Filed: Jul. 5, 2018

(86) PCT No.: PCT/EP2018/068279
§ 371 (c)(1),
(2) Date: Dec. 31, 2019

(87) PCT Pub. No.: WO2019/008107
PCT Pub. Date: Jan. 10, 2019

(65) Prior Publication Data

US 2020/0124345 A1 Apr. 23, 2020

Related U.S. Application Data

(60) Provisional application No. 62/529,599, filed on Jul. 7, 2017.

(51) Int. Cl.
*F25J 1/02* (2006.01)
*F25J 1/00* (2006.01)

(52) U.S. Cl.
CPC ..... *F25J 1/0022* (2013.01); *F25J 1/005* (2013.01); *F25J 1/0035* (2013.01); *F25J 1/0042* (2013.01);
(Continued)

(58) Field of Classification Search
CPC ..... F25J 1/0022; F25J 1/0035; F25J 1/0042; F25J 1/005; F25J 1/0072; F25J 1/0259;
(Continued)

(56) References Cited

U.S. PATENT DOCUMENTS 2,940,268 A * 6/1960 Morrison ..... F25J 1/0022 62/7
3,735,601 A 5/1973 Stannard, Jr.
(Continued)

FOREIGN PATENT DOCUMENTS

CN 1261925 A 8/2000
CN 101711335 A 5/2010
(Continued)

OTHER PUBLICATIONS

Karspeck, Sabine; International Search Report for PCT/EP2018/068279; dated Oct. 31, 2018; 4 pages.

*Primary Examiner* — Brian M King
(74) *Attorney, Agent, or Firm* — Shackleford, Bowen, McKinley & Norton, LLP

(57) ABSTRACT

A method for large-scale offshore LNG production from natural gas gathered from an onshore gas pipe network is described. The natural gas is pre-treated on an onshore facility for removal of mercury, acid gas, water and C5+ hydrocarbons, and then compressed and piped to an offshore platform for further compression and cooling before being transferred to a floating liquefaction, storage and offloading vessel for liquefaction of the natural gas.

8 Claims, 4 Drawing Sheets

(52) U.S. Cl.
CPC ..... *F25J 1/0072* (2013.01); *F25J 1/027* (2013.01); *F25J 1/0259* (2013.01); *F25J 1/0278* (2013.01); *F25J 1/0283* (2013.01); *F25J 1/0288* (2013.01); *F25J 2220/60* (2013.01); *F25J 2220/66* (2013.01); *F25J 2270/16* (2013.01); *F25J 2290/72* (2013.01)

(58) Field of Classification Search
CPC ..... F25J 1/0277; F25J 1/0278; F25J 1/0283; F25J 1/0288; F25J 2220/60; F25J 2220/66; F25J 2270/16; F25J 2290/72; F17C 3/025; F17C 13/082; F17C 2270/0105; F17C 2270/011; F17C 2270/0113; F17C 2270/0118; F17C 2270/0121
See application file for complete search history.

(56) References Cited

U.S. PATENT DOCUMENTS 3,768,271 A * 10/1973 Denis ..... F25J 1/0052 62/50.3
4,202,648 A * 5/1980 Kvamsdal ..... F25J 1/0022 405/210
6,250,244 B1 * 6/2001 Dubar ..... F25J 1/0022 114/264
6,412,302 B1 7/2002 Foglietta
7,119,460 B2 * 10/2006 Poldervaart ..... F17C 7/04 307/149
8,640,493 B1 * 2/2014 Shivers, III ..... F25J 1/0288 62/611
9,810,478 B2 * 11/2017 Isaacson ..... F25J 1/0278
2004/0154697 A1 * 8/2004 Dupont ..... F17C 5/00 141/382
2006/0010911 A1 * 1/2006 Hubbard ..... F17C 9/04 62/611
2011/0182698 A1 * 7/2011 Foo ..... B63B 25/14 414/137.5
2013/0139526 A1 * 6/2013 Jariwala ..... F25J 1/0259 62/53.2
2013/0283825 A1 * 10/2013 Bernays ..... F25J 1/0022 62/53.2
2015/0000334 A1 * 1/2015 Edwards ..... F25J 1/0222 62/611
2015/0198288 A1 * 7/2015 Wyllie ..... F17C 6/00 62/50.1
2015/0253072 A1 * 9/2015 Isaacson ..... F25J 1/0278 62/611
2015/0316208 A1 * 11/2015 Bae ..... F25J 1/0042 62/53.2
2016/0231050 A1 * 8/2016 Faka ..... F25J 1/0022
2017/0167787 A1 * 6/2017 Pierre, Jr. ..... F25J 1/0277

FOREIGN PATENT DOCUMENTS

CN 102725604 A 10/2012
WO WO-2016050840 A1 4/2016

* cited by examiner

LARGE SCALE COASTAL LIQUEFACTION

TECHNICAL FIELD

The present invention relates to coastal production of liquefied natural gas, with maximum exploitation of the economies of scale, where gas processing occurs in three locations, gas pre-processing onshore, piping of pre-processed gas to a coastal platform for mixing with compressed, recirculated gas, and further piping of the gas mixture to a ship shaped coastal floating LNG liquefaction, storage and offloading unit. Specifically, the liquefaction capacity on the floating LNG liquefaction, storage and offloading unit is maximized within constraints imposed by exclusively employing air cooling both on the platform and the vessel, by using multiple inherently safe but relatively small pre-cooled nitrogen expansion liquefaction processes, and by the available deck area of standard, dock-able ship sizes.

BACKGROUND ART

Natural gas is becoming more important as the world's energy demand grows as well as its concerns about air and water emissions increase. Gas is much cleaner-burning than oil and coal and does not have the hazard or waste deposition problems associated with nuclear power. The emission of greenhouse gas is lower than for oil, and only about one third of such emissions resulting from combustion of coal. Natural gas is readily available, from gas reservoirs, from shale gas, from gas associated with oil production, from pipelines in industrialized areas, and from stranded gas sources far from infrastructures.

When gas pipelines are uneconomic or impractical, such as transportation of gas over very large oceanic distances, the best way to transport gas is often in the form of Liquefied Natural Gas (LNG), which is gas cooled to about −160° C. to form a stable liquid at or very near atmospheric pressure. Suitable gas mainly comprises methane with some ethane, propane, butane, pentane and traces of nitrogen.

LNG is produced using two major processing steps. The first step, taking place at typically 40 to 60 bara, is gas pre-treatment to remove free water, mercury, $H_2S$, $CO_2$, water vapour and finally heavy hydrocarbons. Specification for residual mercury is typically <0.01 μg/Nm3, for residual $H_2S$<2 ppmv, for residual $CO_2$<50 ppmv, and, of critical importance, for water vapour a very low value of <0.1 ppmv. After removal of these components, heavy hydrocarbons are removed such that the concentration of residual pentane and heavier is less than 1000 ppm, while the concentration of residual hexane and heavier is less than 100 ppm. The resulting liquefaction ready gas may typically contain methane concentration above 85% on a molar basis, often well above 90%, ethane in the range from below 1 to about 10%, propane in the range from below 0.1 to about 3%, with butane and pentane in the range from below 0.1 to 1%. Nitrogen concentration may be in the range from below 0.1 to 2%.

The second processing step is liquefaction of the thus purified gas, which then comprises mainly methane. This occurs at the same pressure as the gas pre-processing, or, in some cases, preferentially at higher pressures such as 80 to 100 bara. After liquefaction nitrogen may be removed from the LNG, typically any amount that exceeds 1 mole %. This is done by flashing of the LNG at near atmospheric pressure. This flash produces the final LNG product, and a much smaller hydrocarbon gas stream enriched in nitrogen, mainly used for fuel. The final LNG product is liquid at atmospheric pressure and about −160° C. It is stored in buffer storage tanks before being transported to destinations in LNG tankers. At the destination, the LNG is re-gasified and distributed to consumers.

Single train LNG plant sizes range from less than 0.05 million metric tons annually (MTPA) for peak-shaving plants, via small to medium scale LNG plants in the range from 0.05 to about 2.0 MTPA, to large conventional plants producing up to about 4.0 MTPA. Larger production rates may be accomplished in multiple parallel LNG plants.

The safest natural gas liquefaction process employs nitrogen refrigerant, optionally with liquefaction gas pre-cooling. Pre-cooling of liquefaction gas is accomplished by employing refrigerants other than nitrogen, such as Freon, ammonia or $CO_2$, that are more efficient than nitrogen refrigerant at high temperatures. The specific liquefaction energy for pre-cooled nitrogen processes depends on heat sink, water or air, temperature, on gas composition and rotating equipment efficiencies, and may be typically about 350 kWh per metric ton LNG. An alternative to nitrogen refrigerant, single mixed hydrocarbon refrigerant, exhibits about the same specific liquefaction energy. However, the hydrocarbon refrigerant poses a greater fire and explosion risk.

Recent technical developments have provided possibilities for gas liquefaction on floating vessels, FLNG. This is attractive in because the liquefaction can be done near the gas source, which is often offshore, or alternatively near shore. Furthermore, the vessel may provide space for liquefaction processes as well as buffer storage for LNG. In addition vessels may serve as deep-water export terminals.

U.S. Pat. No. 8,640,493 B1 describes a method for offshore liquefaction of natural gas from sub-sea wells, comprising an on-site gas production platform that also pre-processes and compresses the gas, transfer of the gas to a dis-connectable transport vessel in close proximity, that also assists liquefaction, and disconnection and travel by the transport vessel to a terminal for offloading.

The liquefaction is accomplished on the transport vessel by reception of compressed gas via a flexible hose and dis-connectable turret, where the gas flow is split in two, one part pre-cooled in a cryogenic heat exchanger and then expanded, providing cooling for the second part by heat exchange. The expanded gas is partly compressed using power from the expander and then recycled to the platform in a second flexible hose for full re-compression. Liquefaction of the second part is completed on the transport vessel by a nitrogen expander cycle and heat exchange with the gas. This cycle is powered by the transport vessel main propulsion engine.

U.S. Pat. No. 6,412,302 B1 describes liquefaction where the feed gas is cooled by heat exchange with two refrigerants, one being the liquefaction gas itself and the other being a gaseous refrigerant such as nitrogen.

The object of the present invention is to provide a method and a plant for very large scale floating LNG production, using gas supplied from on-shore pipelines, at a cost that competes with land-based LNG production at the same scale and in the same geographical region. The floating LNG production shall also reduce LNG cost to a level where LNG based power may compete with coal based power. This will result in a large expansion of the LNG market and much reduced emissions including $CO_2$.

SUMMARY OF INVENTION

The present invention relates to a method for large scale floating liquefaction of natural gas gathered from onshore gas pipeline networks, the method comprising:

a) Gas gathering from on-shore pipeline quality gas sources and treating the gas on shore by removal of mercury, removal of acid gas, dehydration and removal of C5+ hydrocarbons,
b) compression and cooling of the treated gas;
c) piping of the compressed gas from onshore to an offshore platform;
d) mixing the gas from onshore with a compressed recycle gas flow;
e) piping of the compressed gas mixture in sub-sea pipes from the platform to a floating liquefaction, storage and offloading vessel;
f) distribution and introduction of the compressed gas on the vessel, via a manifold, to two or more liquefaction modules;
g) withdrawing a side draw flow of the gas introduced into each liquefaction module, expanding, and thereby cooling this gas flow in turbo expanders;
h) cooling the remaining gas flow introduced into each of the liquefaction units to −10° C. or lower by counter-current heat exchange with the expanded side draw gas from step g);
i) collecting expanded side gas flows from each liquefaction module in a manifold and piping this gas to the offshore platform as a recycle gas flow,
j) compressing the expanded gas on the platform, and cooling of the compressed gas;
k) mixing the compressed recycle gas flow with compressed gas from shore;
l) further cooling and liquefaction of the gas on the vessel, in each liquefaction module, by heat exchange with pre-cooled and expanded refrigerant;
m) each liquefaction module is powered by a dedicated gas turbine driven compressor for refrigerant compression;
n) introducing produced LNG in multiple membrane tanks.

According to one embodiment, the process further comprises offloading of LNG onto tank vessel using side by side offloading while the liquefaction processes are in full production, by means of vessel offloading arms located on the opposite side of process air coolers mounted on a cantilever.

According to one embodiment, all cooling and intercooling of compressed refrigerant in the liquefaction modules is carried out in air coolers.

According to a further embodiment, the air coolers on board the vessel are arranged on cantilevers extending along at least 50% of the vessel length and mounted on one side of the vessel only.

According to a further embodiment, LNG produced onboard the vessel is offloaded onto a tank vessel arranged side by side while the liquefaction processes are in full production, by means of vessel offloading arms located on the opposite side of the cantilever and air coolers.

According to one embodiment, the refrigerant is nitrogen.

According to one embodiment, the cooling in step j) is carried out in air cooler(s).

According to another embodiment, the distance between the vessel and the offshore platform is from 1 to 50 km.

DETAILED DESCRIPTION OF THE EMBODIMENTS

Figure 1A:
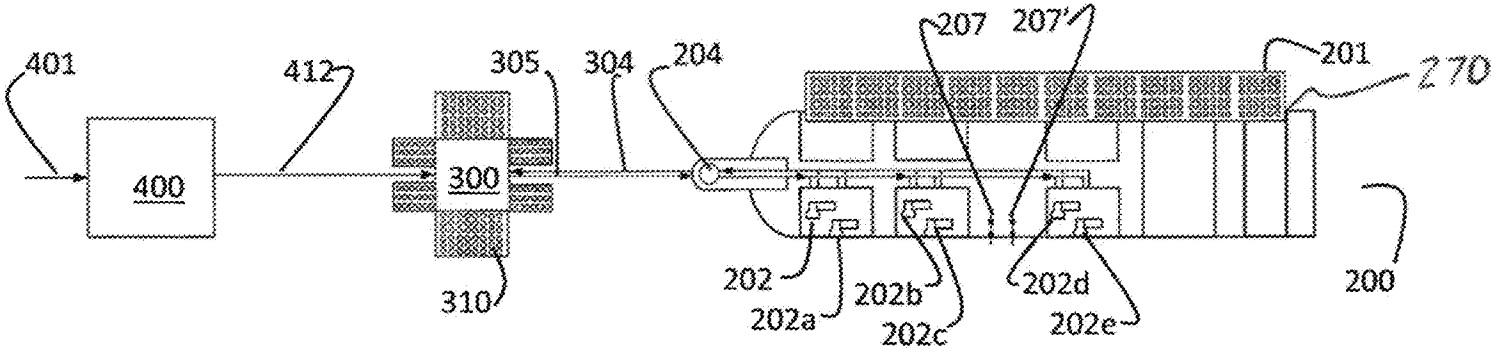
FIG. 1*a* is a top and 1*b* is a side view diagram of very large scale floating production of LNG from onshore pipeline gas with gas pre-processing onshore, piping of gas to an offshore platform for gas compression, air cooled with air coolers on a cantilever, and further piping of gas to a permanently moored gas liquefaction, storage and offloading vessel, also air cooled with air coolers on a cantilever, located at a distance from the platform safe for offloading operations without vessel disconnection, usable in an embodiment of the method.

In the present description and claims the term "natural gas" or "gas" is used for a gas comprising low molecular weight hydrocarbons, which during cooling to produce LNG might be under sufficient pressure to provide supercritical state where it remains a single phase, or at lower pressures where, depending on temperature, there may be gas only, mixtures of gas and liquid, or liquid only. The cooling process may include pre-cooling, which may be any degree of cooling down to about −60° C., main cooling which may be any degree of cooling in the temperature range from pre-cooled temperature to about −100 to −130° C., and sub-cooling which is further cooling to LNG temperature, where the LNG is stable, or gives only very small amounts of gas, such as 1 to 2% on mass basis, when fully expanded to atmospheric pressure. In some cases, the term "cooling" is used for both pre-cooling, main cooling and sub-cooling.

Natural gas is found in geological formations either together with oil, in gas fields, and in shale as shale gas. Dependent on the source, natural gas may differ in hydrocarbon composition, but methane is almost always the predominant gas. The skilled person within this technical area will have good knowledge of the abbreviations LNG and NGL, i.e., Liquefied Natural Gas, and Natural Gas Liquids, respectively. LNG consists of methane normally with a minor concentration of $C_2$, $C_3$ $C_4$ and $C_5$ hydrocarbons, and virtually no $C_{6+}$ hydrocarbons. LNG is a liquid at atmospheric pressure at about −160° C. NGL, on the other hand, is a collective term for mainly $C_{3+}$ hydrocarbons, which exist in unprocessed natural gas. LPG is an abbreviation for liquefied petroleum gas and consists mainly of propane and butane.

The pressure is herein given in the unit "bara" is "bar absolute". Accordingly, 1.013 bara is the normal atmospheric pressure at sea level. In SI units, 1 bar corresponds to 100 kPa.

The expression "ambient temperature" as used herein may differ with the climate for operation of the plant according to the present invention. Normally, the ambient temperature for operation of the present plant is from about 0 to 40° C., but the ambient temperature may also be from sub-zero levels to somewhat higher than 40° C., such as 50° C., during some operating conditions.

The invention relates to a method for very large-scale floating production of liquefied natural gas, in coastal areas, at a scale and with an efficiency that can compete with on-shore gas liquefaction in the same geographical region and from the same on-shore pipeline gas sources.

The process takes place at three different locations. The first location is onshore in the vicinity of a natural gas pipeline network which can provide the required amounts of gas. Gas pre-processing and compression takes place at this location.

The compressed gas is piped in rigid, large-scale pipes from the first location, onshore, to second process location, typically 10 to 100 kilometres offshore. At this second location, a coastal fixed or floating platform, the gas from on-shore is received and, without further compression, mixed with gas flow circulating between the second and a third process location. This gas mixture is piped in large scale, mainly rigid pipes to the third process location.

The third process location is a ship-shaped, permanently moored liquefaction, storage and offloading vessel with very large liquefaction capacity such as 12 million tonnes per year or 3 times more than the largest floating production made so far. It is located in the vicinity of the second process location, typically 2 to 10 kilometres away, such that off-loading from the ship-shaped vessel to a trading tanker can take place safely, without disconnection or interruption of the liquefaction process and without any danger of conflict with the facility at the second process location.

At the first process location, onshore, pipeline quality gas can be gathered from regional gas sources. The pre-processed pipeline gas adheres to specifications for maximum content of a range of contaminants including $H_2S$, $CO_2$, water and NGLs. However, these specifications are not acceptable for LNG. Therefore, the onshore process that receives this gas starts by polishing the gas. Excess amounts of contaminants are first removed.

This includes mercury vapour, which can be removed by adsorbent that irreversibly binds the mercury. Downstream of this, the process can remove any excess amounts of $H_2S$ and $CO_2$.

Acid gases can be absorbed in a counter-current absorption column using an aqueous amine solution. The amine solution is subsequently regenerated by temperature and pressure swing, and then recirculated to the absorption column for re-use.

The pipeline gas contains unacceptable amounts of water vapour. In addition, the gas is nearly saturated with water vapour in the acid gas removal process. A very efficient process for water vapour removal is adsorption in a molecular sieve, capable of adsorbing water to levels where no water precipitates at LNG temperatures. The molecular sieve is fully regenerated by flowing warm, dehydrated gas over the adsorbent in a direction opposite to the adsorption flow. The humid gas from the regeneration process can be cooled to precipitate and separate water, and then re-cycled to the dehydration process inlet.

Further onshore gas processing can include cooling and subsequent expansion in a turbo expander. This produces low temperatures gas, for example −30 to −60° C. Heavy hydrocarbons, mainly C5+, will partially precipitate as a separate liquid phase. The remaining C5+ concentration in the gaseous phase will be low enough for the much deeper cooling associated with LNG, without causing the formation of hydrocarbon solids in the liquefaction processes. The liquid hydrocarbon phase can be removed from the cold mixture and stabilized in a distillation column, forming stable NGL and a gas phase that can be compressed and mixed with the main gas flow. The main gas flow can be compressed in a compressor powered by the turbo expander, thus partially recovering the original gas pressure. At this point, the main gas flow is ready for liquefaction.

All of the above pre-processing can take place at for example 40 to 60 bara. However, at the first process location, onshore, a final process can take place that significantly reduces the gas liquefaction work at process locations two and three offshore. This is compression of the gas to for example 110 to 140 bara, followed by after-cooling to near ambient temperature. Compressor driver can be a gas turbine fueled by a small side draw of pre-processed gas. Gas liquefaction involves reduction of the enthalpy content of the gas. Compression reduces the gas enthalpy. This compression therefore brings the gas a step closer to LNG in terms of enthalpy, such as 10 to 20% of the way to LNG. Compression of the gas also facilitates pipeline transport of the gas to offshore by reducing the gas volume, velocity and pressure drop.

From the onshore process facility, the gas can be piped to the second process location, an offshore fixed or floating platform. No further processing of this gas from shore takes place on the platform. The gas can instead be mixed with another compressed gas stream and the mixture piped directly to the third process location, the floating liquefaction, storage and offloading vessel.

The platform can produce this other compressed gas stream by receiving low pressure, high enthalpy gas from the vessel, the third processing location, compress this gas in compressors driven by gas turbines, and then cool the compressed gas to near ambient temperature in air coolers mounted on platform cantilevers. The compression and cooling reduces the total enthalpy of the gas. Similar to the compression onshore, this enthalpy reduction can contribute to the total gas liquefaction work. While the compression onshore brought the gas 10 to 20% of the way to LNG, the platform assists in bringing the gas an additional 30 to 40% of the way to LNG.

The third process location, a ship shaped vessel, weathervaning with an external turret, has only three main functions, very large scale gas liquefaction, LNG buffer storage and LNG side by side or parallel offloading without disconnecting or interruption of the liquefaction process. The side by side offloading can be by offloading arms on one side of the vessel, such as the port side. The vessel may be the largest that can be accommodated in standard size yard docks such as length about 380 to 400 m and breadth about 64 m. In order to minimize sloshing the LNG is stored in multiple smaller membrane tanks, for example 12 tanks, 6 on port side and 6 on the starboard side, each with 25,000 m3 storage volume. The membrane tanks provide for a flat vessel deck and the full deck, except space occupied by accommodations and offloading arms, can be used for liquefaction process and associated utility equipment.

Gas is piped from the platform to the vessel via rigid, sub-sea pipes and flexible risers. The vessel can hold liquefaction capacity up to 12 million tonnes per year, assuming 345 days of operation annually. Power can be supplied by gas turbine direct drive compressors. Gas turbine air intake can be on the port side of the vessel. Heat, the sum of energy supplied by compressors to nitrogen refrigerant and heat removed from the gas to be liquefied, can be dissipated to ambient air from cantilever mounted, forced draft air coolers.

The liquefaction process on the vessel operates by receiving gas via a turret and a swivel, and piping this gas to a centre manifold running almost the full length of the vessel where gas can be distributed to multiple independent, gas turbine operated gas pre-cooling and liquefaction processes or modules. The gas flow entering each process can be split in two, with roughly one third, the liquefaction gas, routed to the warm side of a gas-gas heat exchanger. The rest, about two thirds of the incoming flow, can be routed directly to a turbo expander. The expanded gas flow, now cold such as for example −50° C., is again split in two. One of these flows, about 80 to 90%, is routed to the cold side of the gas-gas heat exchanger, counter-current to the liquefaction gas on the warm side. The liquefaction gas can thus be cooled by heat exchange with the expanded gas.

The second flow from the gas turbo expander, about 10 to 20%, can be piped to a nitrogen pre-cooling heat exchanger, assisting the pre-cooling of pressurized nitrogen refrigerant. The thus assisted nitrogen pre-cooling produces parallel composite curves in the nitrogen pre-cooling heat exchanger, optimizing the liquefaction process efficiency, as will be discussed below. Spent low pressure gas from gas and nitrogen pre-cooling can be routed to a second gas manifold at the vessel centre, which collects gas from all liquefaction plants. This gas is piped back to process location number two, the fixed or floating platform, via a swivel and rigid, sub-sea pipelines, for re-compression and cooling in air coolers.

Each nitrogen expansion liquefaction process can operate by compressing nitrogen gas using a gas turbine driven compressor and supplementary power from the gas pre-cooling turbo expanders. While 10 to 20% of the liquefaction energy and associated air cooling was supplied at the first process location on shore and 30 to 40% of the mechanical energy input with associated air cooling was supplied on at the second process location, the fixed or floating platform, the remaining power input, with associated air cooling, about 40 to 60%, is thus supplied at the liquefaction vessel in the form of nitrogen compression.

The nitrogen compressors can be inter and after—cooled in full vessel length, cantilever mounted air coolers located on the side of the vessel being opposite of the offloading arms, such as at the starboard side of the vessel. This can cool the compressed nitrogen to about 10 to 15° C. above the ambient air temperature. The compressed and cooled, low enthalpy nitrogen is pre-cooled and then expanded in two steps, one to provide low temperature nitrogen that liquefies natural gas by heat exchange, and a second step to lower temperature and pressure, providing low temperature nitrogen for sub-cooling of the liquefied natural gas.

The liquefied natural gas is finally de-pressurized in a hydraulic expander, flashed to remove nitrogen, and pumped to storage. Flash gas and boil-off gas from tanks are used for gas turbine fuel together with supplementary gas from the feed gas manifold.

Recent developments in gas production have uncovered vast new gas resources. One is onshore fracking technology, which now supplies gas to pipeline networks including networks in coastal regions. Another is technology in the area of two phase flow, enabling the pipeline transportation of offshore gas to shore without significant treatment.

This invention aims to optimize the exploitation and transport of such gas resources. For transport by trade carriers, onshore LNG plants must be in close proximity to the sea. It will now be possible to move the large processing facilities, liquefaction, offshore out of sight from shore and free up valuable land areas in close proximity to the coast. Simultaneously, the liquefaction facilities will naturally provide storage in the vessel hull, and also serve as deep-water ports, sometimes outside the most congested shipping lanes.

Some jurisdictions possess vast gas reserves offshore, not too far from the coast. These jurisdictions often want the gas landed on-shore such that parts of the gas can be used for local consumption. New pipeline technologies enable the landing of such gas even if it becomes two phase pipe flow and the flow is up-hill. Depending on political stability, however, gas exporters may not want the gas landed, because all of their most expensive equipment could be exposed should unrest erupt. This invention provides a cost efficient compromise, where untreated gas can be landed onshore in multi-phase pipelines, where it is prepared for local consumption, and where parts of this gas are dedicated to LNG. Liquefaction can take place offshore, and the expensive liquefaction and LNG storage and offloading systems will be less exposed to any local unrest. At the same time, the project will have significant local content and provide work for local populations.

A very significant advantage with the invention is that the gas received may vary in composition. The first process location may be tailor made for the local gas. The second and third process locations, both offshore, will then treat more uniform gas and can be standardized for use virtually anywhere with minor modifications. Benefits are especially important if more than one LNG site is developed.

The offshore platform and vessel can to a large degree be constructed in the controlled environment of a ship yard. Furthermore, the process can be modularized both for the platform and the vessel which saves cost. It will be possible to move platform modules onto the vessel, making the vessel self-contained without need for a platform, at the expense of reduced LNG production rates.

The use of nitrogen expansion liquefaction trains maximizes the vessel inherent safety. Furthermore, the use of air cooling provides the best environmental performance. Although nitrogen expansion liquefaction has relatively low efficiency, increasing power requirement and increasing the amount of heat that must be dissipated, and air cooling requires much space, the design permits this attractive combination.

The efficiency of the nitrogen expansion liquefaction process is enhanced by the natural gas pre-cooling, and the overall air cooling or heat dissipation is distributed between the three process locations. In particular, the gas pre-cooling is accomplished by expansion of a side draw of feed gas on the vessel without prior cooling of this side draw. This maximizes the side draw volume and hence the amount of energy extracted in the turbo expander, optimizing cooling effects. The use of some expanded and cold gas for nitrogen pre-cooling eliminates an extra turbo expander which would otherwise have been needed, and is also more efficient.

The use of the pre-cooling expander power for nitrogen refrigerant compression maximizes the liquefaction capacity on the vessel.

The following narrative provides a description of the drawings and an example.

Figure 1B:
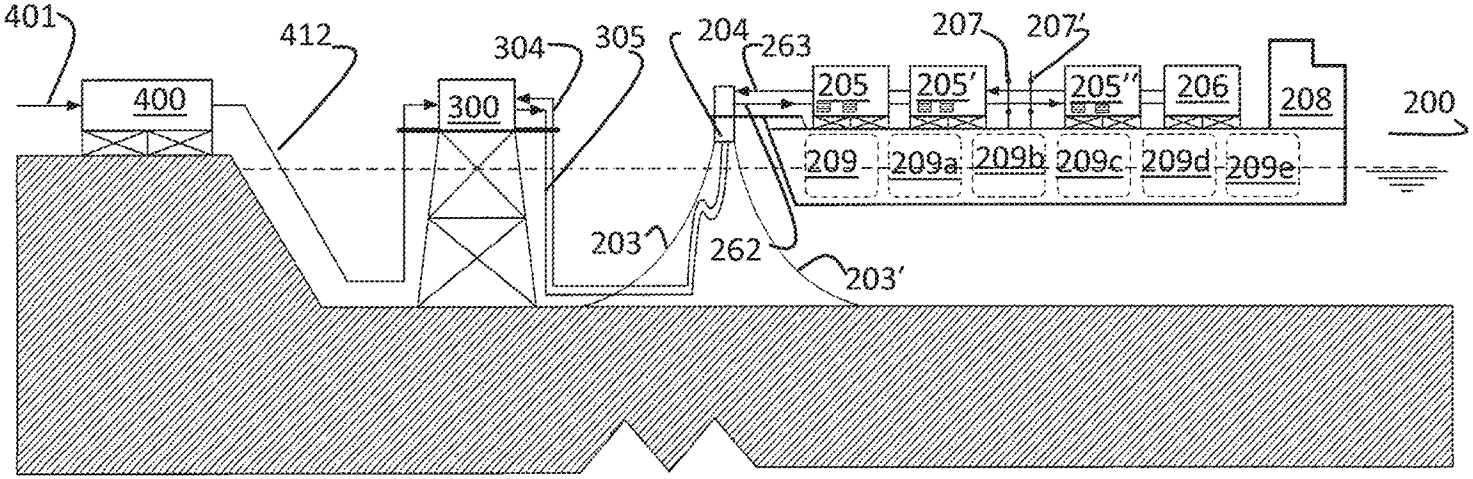

FIG. 1 *a*) and *b*) shows a side view and a top view, respectively, of the overall system. Pipeline quality gas flows via a conduit 401 to an onshore pre-processing plant 400, process location one, which will be discussed below. Pre-processed gas, without compounds that can contaminate downstream equipment of form solids in cryogenic processes, is piped in a pipeline 412 to an offshore floating or fixed platform 300, process location two. This platform receives gas from a sub-sea, rigid and large capacity pipeline 304, compresses this gas and dissipates heat from cantilevered air coolers 310. The compressed gas is mixed with gas from the pipeline 412 and directed to a floating liquefaction, storage and offloading vessel 200, the process location three, via a sub-sea pipeline 305 and a swivel 204. The vessel is weathervaning using an external turret, moored by mooring lines 203, 203'. The vessel 200 also includes accommodations 208.

On the vessel, gas is distributed via a manifold 262 to multiple liquefaction units 205, 205', 205", each containing two liquefaction process modules powered by gas turbines 202, 202 a-e. Recycle gas from each process train is collected in a manifold 263 and piped to the platform 300 via the swivel 204 and the pipe 304. Heat from the liquefaction processes is dissipated via air coolers 201. Offloading of LNG onto a tank vessel side by side offloading while the liquefaction processes are in full production, via vessel offloading arms 207, 207' located on the opposite side of a cantilever 270 and the air coolers 201 of the vessel. The air coolers 201 may be arranged on the cantilever 270, the cantilever extending along at least 50% of a length of the vessel 200 and mounted on only one side of the vessel 200. LNG produced onboard the vessel 200 may be offloaded onto a tank vessel arranged side by side while the liquefaction processes are in full production, via the vessel offloading arms 207,207' located on the opposite side of the cantilever 270 and the air coolers 201. LNG produced onboard the vessel 200 may be offloaded onto a tank vessel arranged side by side while the liquefaction processes are in full production, via the vessel offloading arms 207, 207' located on the opposite side of the cantilever 270 and the air coolers 201. The vessel LNG storage tanks 209, 209 a-e, are located on the port side with a similar set of not shown tanks on the starboard side. The vessel 200 has the offloading arms 207, 207' for side by side LNG offloading.

Figure 2:
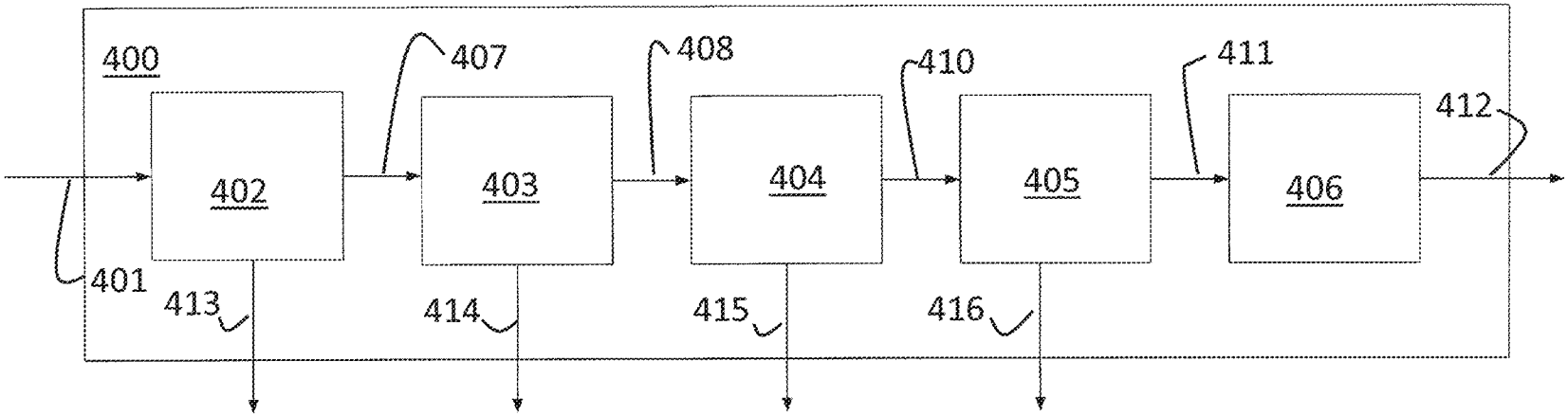
FIG. 2 is a schematic diagram of the onshore gas pre-processing process with mercury and sour gas removal, dehydration, heavy hydrocarbon removal and compression for piping to offshore facilities, usable in an embodiment of the method.

FIG. 2 shows the sequence of processes at the onshore pre-processing plant 400. Pipeline quality gas received via the conduit 401 is treated in a mercury removal unit 402. Mercury is irreversibly absorbed on a pre-sulfided metal oxide absorbent. Spent absorbent is removed batch-wise in a stream 413 after several years of operation, and replaced via a not shown absorbent input stream.

The treated gas from unit 402 is directed to an acid gas removal unit 403 via a conduit 407. For pipeline quality gas the acid gases are mainly $H_2S$ and $CO_2$. Both can be removed from the hydrocarbon gas by selective and reversible absorption into a suitable sorbent, typically an amine/water mixture. The absorption is accomplished by countercurrent flow of gas and absorbent in a packed column at near ambient temperature. The rich absorbent, loaded with the acid gases, can be re-generated by heating and stripping with steam. The separated acid gases are removed in a conduit 414. The regenerated absorbent is re-cycled for re-use, and the sweet hydrocarbon gas is directed to a dehydration unit 404 via a conduit 408.

The gas is dehydrated by $H_2O$ adsorption in a molecular sieve such as a synthetic zeolite. Suitable zeolites have an extremely strong affinity for $H_2O$. Within the zeolite, there are three zones, one at the gas inlet that is nearly saturated with $H_2O$, and adsorption zone where $H_2O$ is actively adsorbed, and a third zone that is normally dry, polishing the gas from upstream zones. The adsorption takes place at ambient temperature. The molecular sieve can be fully regenerated, controlled by timers such that of three adsorption units, two are in adsorption mode and one is in for example an eight hour regeneration mode. Regeneration is accomplished by flowing dry gas over the molecular sieve at high temperature such as for example 300° C. This gas is subsequently cooled to precipitate water and re-cycled to the dehydration or acid gas removal unit inlet in a not shown conduit. Water from the dehydration unit is removed in a conduit 415 and dry gas is directed to a unit for the removal of heavy hydrocarbons 405 in a conduit 410.

Heavy hydrocarbons, or hydrocarbons that can form solids in cryogenic temperatures, such as C5+ and some aromatics, can be removed from the gas by cooling such that they become liquids and the separated in a liquid knock-out tank. These liquids can then be stabilized and exported. The remaining gas will be liquefaction ready.

Cooling of the gas can be accomplished in two stages, first pre-cooling in a heat exchanger and then expansion to pressure and temperature most suitable for the liquid formation process. After separation, the resulting gas and liquid can be used as coolants in the heat exchanger. Power from the expander, if a turbo expander is employed, can be used for partial gas re-compression. Stabilized, heavy hydrocarbons can be removed from the process in a conduit 416, and liquefaction ready gas directed to a gas compressor 406 in a conduit 411.

While gas pre-treatment can be done at moderate pressures such as 40 to 60 bara, higher pressure such as 110 to 140 bara is much better for pipeline transport of liquefaction ready gas to offshore and much better for liquefaction offshore since the higher pressure gas has reduced enthalpy and lower volume. The compression takes place in gas turbine driven axial compressors with not shown forced draft air after-coolers. The compressed and cooled gas is directed offshore to the second process location in the pipeline 412.

Figure 3:
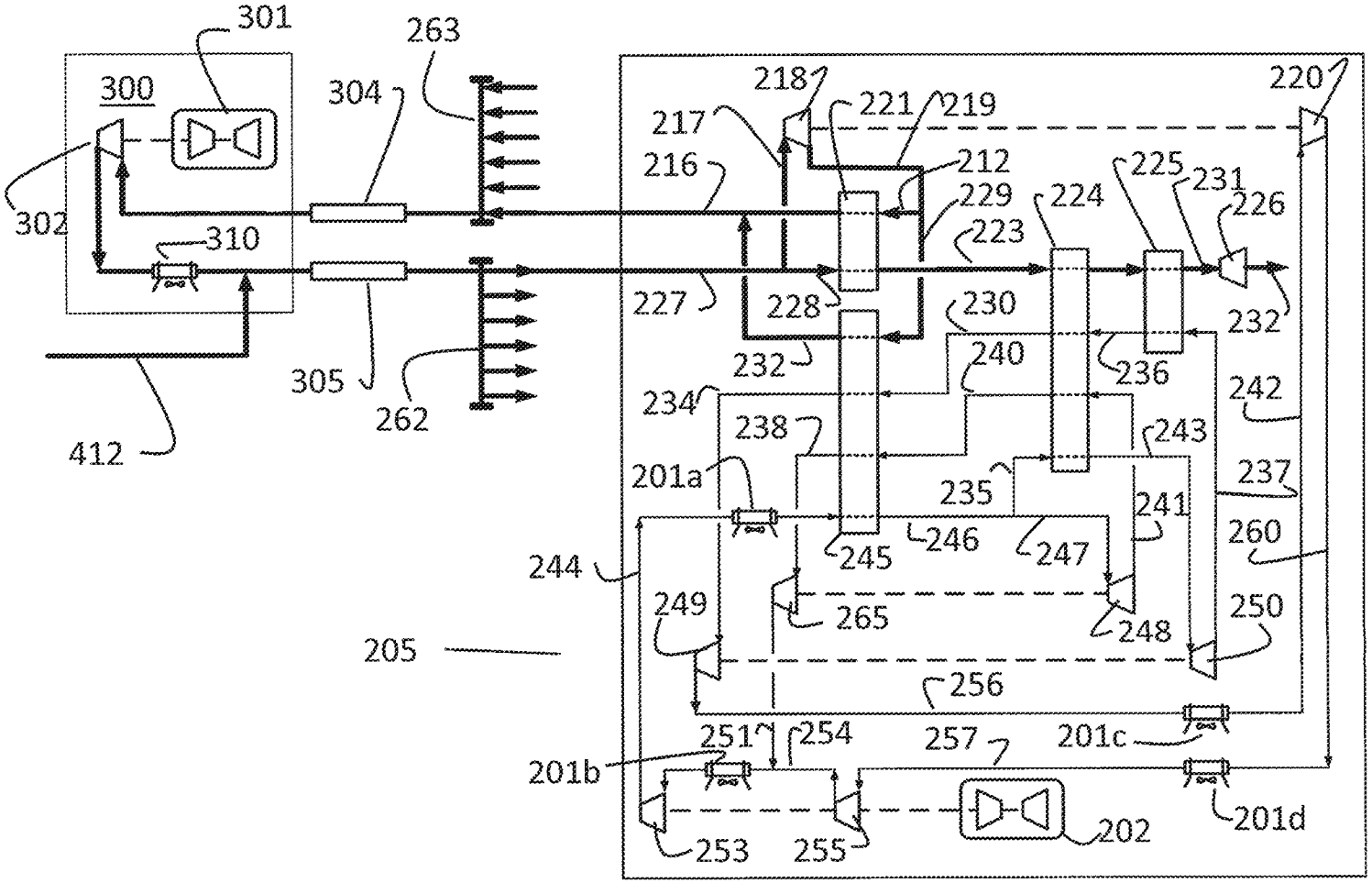
FIG. 3 is a schematic diagram of the liquefaction process with gas compression on a platform, air cooling of compressed gas, sub-sea piping of gas to a floating liquefaction, storage and offloading vessel with manifolds for the distribution of gas to multiple pre-cooled, nitrogen expansion liquefaction processes, each powered by a dedicated gas turbine and power extracted from the feed gas in the pre-cooling process, air cooled with no fluid other than nitrogen on the process side usable in an embodiment of the method.

FIG. 3 shows an overview of the liquefaction process downstream the pre-treatment on the onshore pre-processing unit. This is a process installed at two locations, the offshore platform 300, and the vessel 200, being connected by subsea pipelines 304, 305. Pipelines for natural gas are represented as lines in bold, whereas pipelines for refrigerant, such as nitrogen, are represented by thin lines.

The platform 300 receives low pressure gas from the vessel via the sub-sea pipeline 304. This gas is compressed in a compressor 302 driven by a gas turbine 301. The compressed gas is cooled in cantilever mounted air coolers 310 and mixed with gas from the onshore pre-processing plant 400 being introduced from the conduit 412.

The compressed gas mixture is piped to the vessel 200 in the sub-sea pipeline 305 and distributed to the vessel liquefaction processes via the manifold 262. FIG. 3 comprises a process overview of the platform 300 and one vessel liquefaction unit 205. The skilled person will understand that the arrows on the manifold 262 may be connected to other liquefaction units on-board the vessel 200.

Gas from the manifold 262 is directed into the liquefaction unit 205 in a conduit 227. A side draw of pressurized gas in the conduit 227 is directed via a conduit 217 to a turbo expander 218 where it is expanded to produce low temperature, low pressure gas in a conduit 219. The remaining gas from the conduit 227 is directed in a conduit 228 to the warm side of a heat exchanger 221.

Most of the gas from the conduit 219 is directed to the cold side of the heat exchanger 221 via a conduit 212, cooling the gas from the conduit 228 by heat exchange, thus producing a cold gas stream 223. The rest of the gas in the conduit 219 is directed to a heat exchanger 245 for the pre-cooling of nitrogen refrigerant. Persons skilled in the art will understand that heat exchangers 221 and 245 may be combined into a single unit, accomplishing the same cooling of gas and nitrogen. Low pressure gas from the heat exchangers 221 and 245 are mixed to produce low pressure gas in a conduit 216. This gas is collected, together with low pressure gas from other liquefaction processes on the vessel, in the manifold 263 and then piped to the platform 300 in sub-sea pipe 304, completing the gas pre-cooling cycle.

The pre-cooled gas in the conduit 223 is liquefied in a heat exchanger 224 by heat exchange with nitrogen refrigerant, then sub-cooled in a heat exchanger 225 and finally directed to a hydraulic expander 226 via a conduit 231. The product is LNG at near atmospheric pressure in a conduit 232.

A nitrogen expansion refrigeration cycle powered by a gas turbine 202. Compressed nitrogen in a conduit 244 is cooled in an air cooler 201*a*, further cooled by counter-current heat exchange with expanded nitrogen from conduits 230 and 240, assisted by some pre-cooled gas from the conduit 229. The cold nitrogen exits the heat exchanger 245 in a conduit 246. After side draw of some nitrogen in a conduit 235, the nitrogen is directed in a conduit 247 to a turbo expander 248.

Expansion of nitrogen in the turbo expander 248 produces cold, intermediate pressure nitrogen that is directed to the heat exchanger 224 via a conduit 241. Together with nitrogen from a conduit 236 this serves as refrigerants, cooling and liquefying natural gas from the conduit 223 and cooling nitrogen from the conduit 235.

The intermediate pressure nitrogen from the heat exchanger 224, now partly warmed, exits the heat exchanger in the conduit 240, is directed to the heat exchanger 245 where it is further warmed, next via a conduit 238 to compression in a compressor 265 driven by the turbo expander 248 and then directed in a conduit 251 to the intermediate pressure section of the turbine driven nitrogen compressor, conduit 254.

Side draw nitrogen in the conduit 235 is cooled in the heat exchanger 224, and then directed to a low pressure nitrogen turbo-expander 250 via a conduit 243. The low pressure, low temperature nitrogen from the turbo-expander 250 is then directed via a conduit 237 to the heat exchanger 225, sub-cooling liquefied natural gas by counter-current heat exchange. The thus warmed nitrogen is directed to the heat exchangers 224 and 245 via conduits 236 and 230 respectively and further warmed.

The low pressure nitrogen from the heat exchanger 245 is directed to a compressor 249 via a conduit 234. The compressor 249 is powered by the expander 250. The partly compressed nitrogen can then be directed to an air cooler 201*c* via a conduit 256. Further compression can be done by directing the nitrogen to a compressor 220 via a conduit 242. The compressor 220 is powered by the gas expander 218. This enables the use of mechanical energy, obtained by expansion of gas that was compressed on the platform 300, for local refrigeration work on the vessel 200.

Compressed nitrogen from the compressor 220 is directed to an air cooler 201*d* via a conduit 260, then to the gas turbine driven low pressure compressor 255 via a conduit 257. Compressed nitrogen from the compressor 255, conduit 254, can be mixed with the intermediate pressure nitrogen from the conduit 251, cooled in an air cooler 201*b* and finally compressed to full nitrogen pressure in a compressor 253, completing the nitrogen refrigerant cycle.

Example

A process for the production of 12.0 million tonnes LNG per year, assuming 345 days of operation per year, receives 1 690 tonnes per hour pipeline gas in the conduit 401. The gas pressure and temperature are 50 bara and 25° C., respectively.

TABLE 1

Gas composition before and after pre-processing

| Component | Unit | Before pre-processing | After pre-processing |
|---|---|---|---|
| H2O | Mole % | 0.010 | 0.000 |
| | (ppmv) | | (<0.1) |
| Nitrogen | Mole % | 1.000 | 1.000 |
| CO2 | Mole % | 2.000 | 0.005 |
| | (ppmv) | | (<50) |
| H2S | Mole % | 0.001 | 0.000 |
| | (ppmv) | | (<2) |
| Methane | Mole % | 94.102 | 96.053 |
| Ethane | Mole % | 2.600 | 2.653 |
| Propane | Mole % | 0.200 | 0.204 |
| i-Butane | Mole % | 0.025 | 0.025 |
| n-Butane | Mole % | 0.035 | 0.035 |
| i-Pentane | Mole % | 0.009 | 0.009 |
| n-Pentane | Mole % | 0.006 | 0.006 |
| C6+ | Mole % | 0.012 | 0.010 |
| Total | Mole % | 100.00 | 100.00 |

The gas is pre-processed and compressed to 110 bara in the on-shore plant 400. The remaining mass flow after pre-processing is 1603 tonnes per hour. After not shown side draw of fuel gas, approximately 33 tonnes per hour, the remaining gas, now 1 570 tonnes per hour, is piped to the offshore compressor platform 300 in the 42" pipeline 412.

On the platform there is a not shown side draw of about 28 tonnes per hour fuel gas. The remaining gas, 1 542 tonnes per hour, is mixed with 2633 tonnes per hour of circulation gas, that has been received from pipeline 304, compressed to about 100 bara and cooled to about 40° C. in the air cooler 310.

The total gas flow, 4 175 tonnes per hour, piped to the vessel 200 in the sub-sea pipeline 305. The distance of 3 km provides safe offloading of the vessel without disconnection or production interruption.

On the vessel there is a not shown side draw of 45 tonnes per hour fuel gas. The remaining gas, 4 130 tonnes per hour, is then directed to the centre manifold 262 and distributed to 6 parallel, identical gas pre-cooling, liquefaction and sub-cooling plants. Pre-cooling results in about 439 tonnes per hour of low pressure gas per plant used as pre-cooling refrigerant. These gas flows are collected in centre recycle manifold 263 and returned to the platform.

The remaining, pre-cooled gas, about 248 tonnes per hour per plant, now pre-cooled to −28° C. by heat exchange with the gas used as pre-cooling refrigerant, is further cooled to −82° C. by heat exchange with nitrogen refrigerant in heat exchanger 224, and then to −160° C. in heat exchanger 225 before being expanded to near atmospheric pressure in hydraulic expander 226.

Downstream of the expander 226 the gas is flashed in a not shown flash tank and the resulting LNG is pumped to storage together with LNG from the other liquefaction trains.

The gas from the not shown LNG flash and boil-off gas from tanks are used as fuel gas, supplementing the 45 tonnes of fuel gas from the incoming gas to the vessel. The end result is 12.0 million tonnes of LNG offloaded per year.

The invention claimed is:

1. A method for large scale floating liquefaction of natural gas gathered from onshore gas pipeline networks, the method comprising:

a) gathering gas from on-shore pipeline quality gas sources and treating the gas on shore by removal of mercury, removal of acid gas, dehydration and removal of C5+ hydrocarbons;

b) compressing and cooling the treated gas of step a), thereby yielding compressed gas;

c) piping the compressed gas of step b) from onshore to an offshore platform;

d) mixing the gas from onshore of step c) with a compressed recycle gas flow, thereby yielding a compressed gas mixture;

e) piping the compressed gas mixture of step d) in sub-sea pipes from the platform to a floating liquefaction, storage and offloading vessel;

f) distributing and introducing the compressed gas mixture of step e) on the floating liquefaction, storage and offloading vessel, via a manifold, to two or more liquefaction modules;

g) withdrawing a side draw flow of the gas introduced in step f) into each of the two or more liquefaction modules, expanding, and thereby cooling the side draw gas flow in turbo expanders;

h) cooling remaining gas flow introduced into each of the two or more liquefaction modules to −10° C. or lower by counter-current heat exchange with the expanded side draw gas from step g);

i) using power from turbo expanders in step g) to drive a compressor compressing gas within an internal refrigerant circulation loop onboard the floating liquefaction, storage and offloading vessel;

j) collecting expanded side draw gas flows from step g), after the heat exchange in step h), from each liquefaction module in a manifold and piping the expanded side draw gas flows to the offshore platform as a recycle gas flow;

k) compressing the expanded side draw gas flows from step j) the platform, thereby yielding compressed recycle gas flow, and cooling of the compressed recycle gas flow;

l) mixing the compressed recycle gas flow from step k) with the compressed gas from from onshore from step c);

m) further cooling and liquefaction of a part of the compressed gas from step f) on the vessel, in each liquefaction module, by heat exchange with pre-cooled and expanded refrigerant, the part of the compressed gas being the remaining gas after the withdrawing of the side draw flow of the gas from step g);

n) powering each liquefaction module by a dedicated gas turbine for refrigerant compression; and o) introducing produced LNG in multiple membrane tanks.

2. The method of claim 1, comprising offloading of LNG onto a tank vessel side by side offloading while the liquefaction processes are in full production, via vessel offloading arms located on the opposite side of a cantilever and air coolers of the floating liquefaction, storage and offloading vessel.

3. The method of claim 1, wherein all cooling and intercooling of compressed refrigerant in the liquefaction modules is carried out in air coolers.

4. The method of claim 2, wherein the air coolers are arranged on the cantilever, the cantilever extending along at least 50% of the vessel length and mounted on only one side of the floating liquefaction, storage and offloading vessel.

5. The method of claim 3, wherein LNG produced onboard the floating liquefaction, storage and offloading vessel is offloaded onto a tank vessel arranged side by side while the liquefaction processes are in full production, via vessel offloading arms located on the opposite side of a cantilever and the air coolers.

6. The method of claim 1, wherein the refrigerant is nitrogen.

7. The method of claim 1, wherein the cooling in step k) is carried out in air coolers.

8. The method of claim 1, wherein the distance between the floating liquefaction, storage and offloading vessel and the offshore platform is from 1000 to 20000 meters.

* * * * *